US007418987B2

(12) United States Patent
Duffy

(10) Patent No.: US 7,418,987 B2
(45) Date of Patent: Sep. 2, 2008

(54) CARD-TYPE COIN HOLDER FOLDER

(76) Inventor: Eric W. Duffy, 4500 Cannon Ave. #86, P.O. Box 1778, Klamath Falls, OR (US) 97601

( * ) Notice: Subject to any disclaimer, the term of this patent is extended or adjusted under 35 U.S.C. 154(b) by 544 days.

(21) Appl. No.: 10/948,396

(22) Filed: Sep. 23, 2004

(65) Prior Publication Data

US 2006/0060274 A1 Mar. 23, 2006

(51) Int. Cl.
*A45C 1/06* (2006.01)
*A45C 1/00* (2006.01)

(52) U.S. Cl. ..... 150/136; 206/0.84

(58) Field of Classification Search ..... 150/136, 150/150, 151; 206/0.83, 0.84, 37.1, 0.81; 229/92.9; 232/4 R, 5
See application file for complete search history.

(56) References Cited

U.S. PATENT DOCUMENTS 1,029,836 A * 6/1912 Warne ..... 229/92.9
1,193,771 A * 8/1916 Evans ..... 150/152
1,592,122 A * 7/1926 Moreland ..... 229/92.9
1,827,888 A * 10/1931 Greer ..... 232/5
1,843,879 A * 2/1932 Lincoln ..... 206/0.83
2,077,536 A * 4/1937 Taggart ..... 232/5
3,044,606 A * 7/1962 Frosh ..... 206/0.83
3,348,763 A * 10/1967 Weston ..... 229/92.9
3,913,732 A * 10/1975 Peterson ..... 206/0.83
6,318,547 B1 * 11/2001 Pianezzola ..... 206/0.81

* cited by examiner

*Primary Examiner*—Sue A Weaver
(74) *Attorney, Agent, or Firm*—Donald W. Meeker

(57) ABSTRACT

A plastic card-type coin holder folder device for carrying coins fits in a card-carrying section of a wallet. A rigid card the thickness of the coins has circular cut-outs in which to position the coins. Thin plastic strips across a lower portion of a front of the rigid card hold the coins from the front. A thin plastic backing has holes along the top of the coins for pushing the coins forward to retrieve them from the front. A thin plastic cover attaches to the top of the rigid card and folds down over the front of it and is secured by tucking the cover into one of the coin retaining strips.

9 Claims, 3 Drawing Sheets

CARD-TYPE COIN HOLDER FOLDER

BACKGROUND OF THE INVENTION

1. Field of the Invention

The present invention relates to a device for carrying coins and particularly to a plastic card-type coin holder folder for carrying in a card-carrying section of a wallet or the like comprising a rigid plastic card body receives the coins in circular cut-outs with two thin coin retaining strips attached to the front of the plastic card across the bottoms of the coins for securing the coins in the card and with a thin back sheet having a hole at the top of each coin to assist removal of the coins by pushing the coins forward, and a cover that folds over the plastic body and is secured by tucking said cover into one of the coin retaining strips.

2. Description of the Prior Art

Money of high value is in the form of bank notes, and space is provided in wallets for the bills as well for credit cards and similar documents. Sometimes a small zippered coin pouch is added in the construction of a wallet, but if filled with coins, it tends to add bulk to the wallet and the user cannot fully close the wallet.

Coin holders in the form of a small pocket or a small bag are well known, but inconvenient to use, since the user has to carry both the wallet and the coin holder. Coins are often tossed in a purse, pocket, bag or similar article but this is not practical because it is difficult to remove the coins at the time when the coins are needed.

Prior art devices do not adequately provide a card sized flat coin holder within a folder that secures the coins and yet enables easy removal of the coins.

U.S. Pat. No. 618,497, issued Jan. 31, 1899 to Crabb, provides a coin carrier with paired curved slots cut into one of three panels. The slots form a band over the coin inserted through both slots. The other two panels fold over the coin panel to enclose it.

U.S. Pat. No. 3,511,437, issued May 12, 1970 to Shaad, claims a currency-holding card for coins and paper money with a double layer of material forming one panel having a pair of partial circle cutouts in one sheet leaving a band in between to go over a coin. A pocket is provided for paper money. A second panel closes over the first to cover the coins.

U.S. Pat. No. 1,827,888, issued Oct. 20, 1931 to Greer, discloses a book-type coin bank for receiving and containing coins that has a plurality of sheets that are adhesively attached to each other, which have coin holding apertures. The device is made of such a size as to be conveniently carried in a pocket.

U.S. Pat. No. 1,843,879, issued Feb. 2, 1932 to Love, illustrates a coin purse having a body portion provided with plurality of different sizes apertures for retaining and carrying coins, said purse also has a cover flap with snap fastening closure devices.

U.S. Pat. No. 6,318,547, issued Nov. 20, 2001 to Pianezzola, is for a pocket-size container for metal coins that has a structure in the form and dimensions of a normal credit card, debit card and similar documents, which has a plurality of recesses. A coin is inserted into each of the recesses according to measure.

U.S. Pat. No. 4,037,716, issued Jul. 26, 1977 to Marks, shows a pocket-sized card holder for keys, coins and/or similar items comprised of a thin card having a depressed region therein for receiving and containing the items and a pressure resealable, at least partially adhesively-coated lid which covers the depressed region and which can be stripped or peeled back to expose the contained items. The holder is preferably of credit card size for convenience in carrying, with overall thickness only fractionally greater than the items contained.

U.S. Pat. No. 4,402,398, issued Sep. 6, 1983 to Smoczynski, claims a coin carrying plastic card of a size for carrying in a card carrying section of a wallet or the like. The device includes a plastic card body of a first thickness, a hole in the plastic card body for receiving a coin of a second thickness, an edge on the card surrounding the hole, the hole being of slightly larger than the corresponding dimension of the coin so that the edge on the card lies in contiguous relationship to the edge of the coin, the first thickness being of a sufficiently high proportion of the second thickness so that the edge of the card surrounding the hole will provide support to the edge of the coin, and pressure-sensitive tape affixed to one side of the card and extending across the hole for adhesively securing the coin to the card while permitting selective removal and replacement thereof.

U.S. Pat. No. 6,202,835, issued Mar. 20, 2001 to Morse, protects a change card including a plurality of bays which is configured to hold a combination of coins that allows a user to make exact change for any purchase and/or to receive all of the change resulting from a purchase. The change card includes a body on which the plurality of bays is disposed. Each of the bays is adapted to releasably receive a coin. The change card may be configured to be about the same size as a credit card. A change card configured for use in the United States may include a predetermined number of bays consisting of four bays for receiving pennies, one bay for receiving a nickel, two bays for receiving dimes, and three bays for receiving quarters, which totals 10 coins. Accordingly, exact change may be made for a purchase of given dollar amount and any fractional amount in cents, ranging from 1¢ to 99¢ with only these 10 coins.

U.S. Pat. No. 4,946,030, issued Aug. 7, 1990 to Guridi, puts forth an emergency key holder card which includes a credit card sized key holder card for retaining emergency keys, an emergency coin holder, toothpicks, identification labels, magnifying glass, calendar, or various linear measuring devices.

U.S. Pat. No. 4,300,610, issued Nov. 17, 1981 to China, concerns a holder for keys, coins and the like is generally rectangular in cross-section so that it has an appearance similar to that of a standard credit card. The card-like holder includes a tray member and an insert member which is receivable within the tray member. The tray member includes a rigid frame having opposed faces and an aperture for receiving the insert member. The tray member also includes a flexible film which is disposed over one of the frame faces to form a backing for the frame aperture. The insert member conforms in configuration to the frame aperture so as to be receivable therein. The insert includes a rigid holder portion having a pair of opposed faces and an aperture for receiving the item to be contained in the holder. The insert also includes a flexible film member disposed over one of the insert holder portion faces to form a backing for the insert aperture.

What is needed is a card sized flat coin holder within a folder that secures the coins and yet enables easy removal of the coins.

SUMMARY OF THE INVENTION

An object of the present invention is to provide a card sized flat coin holder within a folder that secures the coins and yet enables easy removal of the coins by providing an opening in a thin back cover behind each coin to push the coin forward so that it is easily grasped to remove the coin from the holder.

A related object of the present invention is that flat plastic strips heat sealed or adhered on three sides in two spaced positions on a rigid plastic card with circular cut-outs formed in two rows for receiving coins for an inexpensive and easy to make and use coin holder.

One more related object of the present invention is to provide an opening in a thin backing sheet behind each of the coins smaller than the coin so that the coin cannot fall through the opening, but sufficiently large to push a finger through the opening to tilt the coin forward so that it is easily grasped and removed from the holder.

An additional object of the present invention is to provide bottom ends of the holder that are trimmed to round off the corners for ease of sliding the holder into a wallet and to prevent sharp corners from poking into a leg of a person if the holder is placed in a pocket.

A further object of the present invention is to provide a fold over portion of the backing sheet shaped with the corners trimmed to fit within the bottom attached strip which has the corners trimmed so that the fold over portion forms a cover to secure the holder closed.

A contributory object of the present invention is to provide a flat card coin holder folder that enables the user to carry change in a wallet while minimizing the bulk so that the user can fully close the wallet.

In brief, a plastic card-type coin holder folder holding six quarters in holes located in the rigid card. Two thin strips of plastic attached at the bottom of the coins across the front hold the quarters to hold the coins. A strip of thin plastic with holes at the tops of the coins is attached to the back of the card to push the quarters forward through the back holes allowing them to be removed from the front of the card in an efficient manner. A thin plastic sheet is attached to the top of the card for folding down over the front of the coins and being tucked between the bottom strip and the card to hold the cover closed, securing the coins in the card holder.

An advantage of the present invention is to provide a card sized flat coin holder that enables easy grasping of the coins to remove them from the holder.

Another advantage of the present invention is that it is an inexpensive and easy to make and use a coin holder.

One more advantage of the present invention is that the bottom ends of the holder are trimmed for ease of sliding the holder into a wallet and to prevent sharp corners from poking into a leg of a person if the holder is placed in a pocket.

Yet another advantage of the present invention is that the fold over portion forms a cover tucked into a bottom strip to secure the holder closed.

Still another advantage of the present invention is that a user can fully close a wallet containing the holder filled with coins.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

In FIGS. 1-4, a coin holder folder device 20 is used for storing a number of coins in a flat array to be stored in a wallet or pocket or purse or other desired location.

Figure 1:
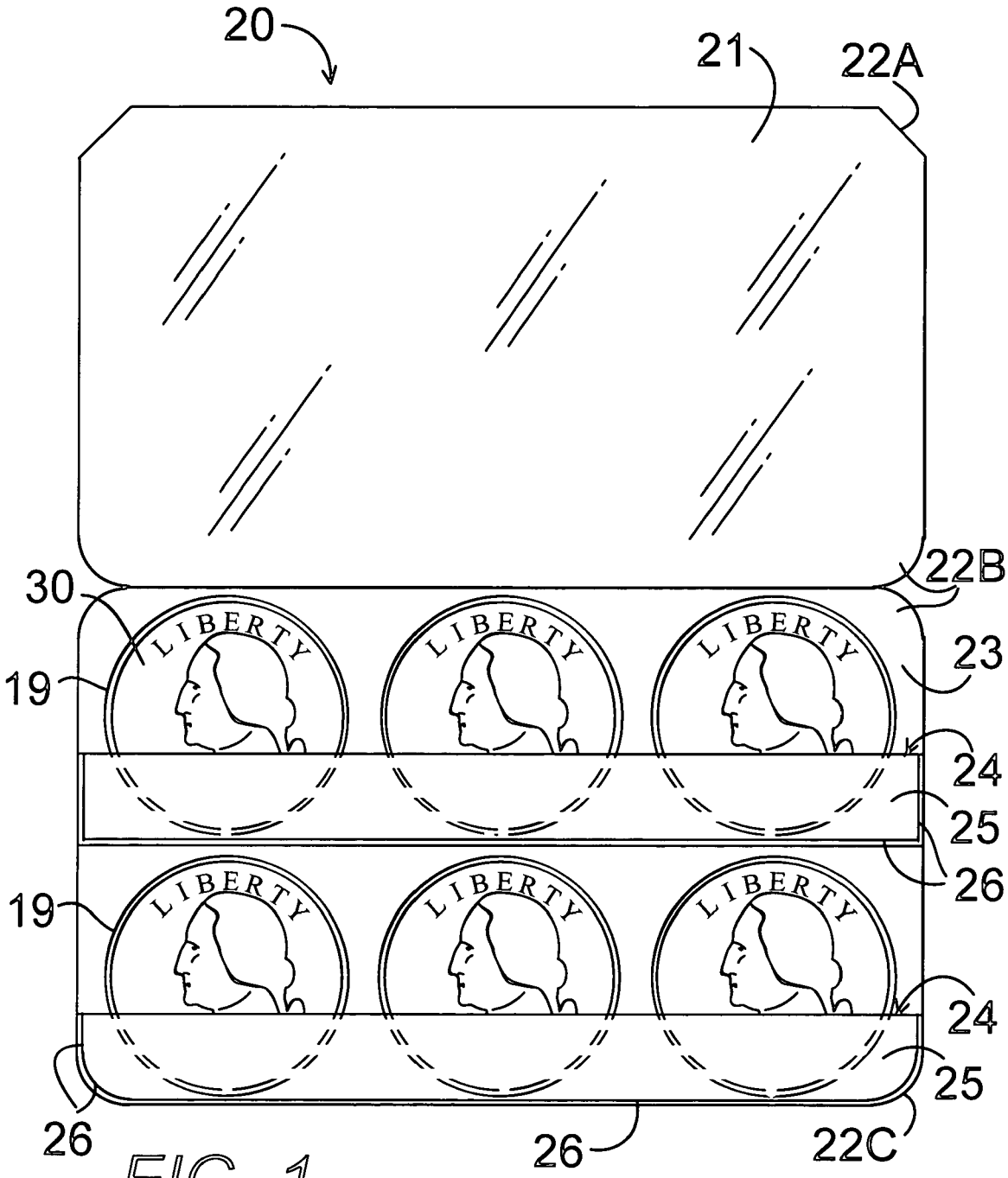
FIG. 1 is a front elevational view of the coin holder folder of the present invention with the cover up showing the six quarters in the six circular openings held in by the two coin holding strips.

A coin holding card 23 comprises a credit card size rigid sheet having preferably two rows of circular openings 19. Each of the circular openings has a diameter slightly larger than a coin 30 to be received therein. A coin-securing strip 25 is attached to a front side of the coin holding card 23 in alignment with each row of circular openings 19 across the bottoms of the openings. Each coin securing strip has four sides with three of the four sides attached by a heat staking border 26 or adhesive to the coin holding card 23 that has a bottom side attached below the row of circular openings 19 and a fourth side at the top open to admit a coin into each of the receiving openings 19. Each coin securing strip 25 has a height preferably less than half a diameter of one of the circular openings 19 so that a major portion of a coin 30 in each circular opening is exposed above the securing strip for ease of removal, as shown in FIG. 1

Figure 2:
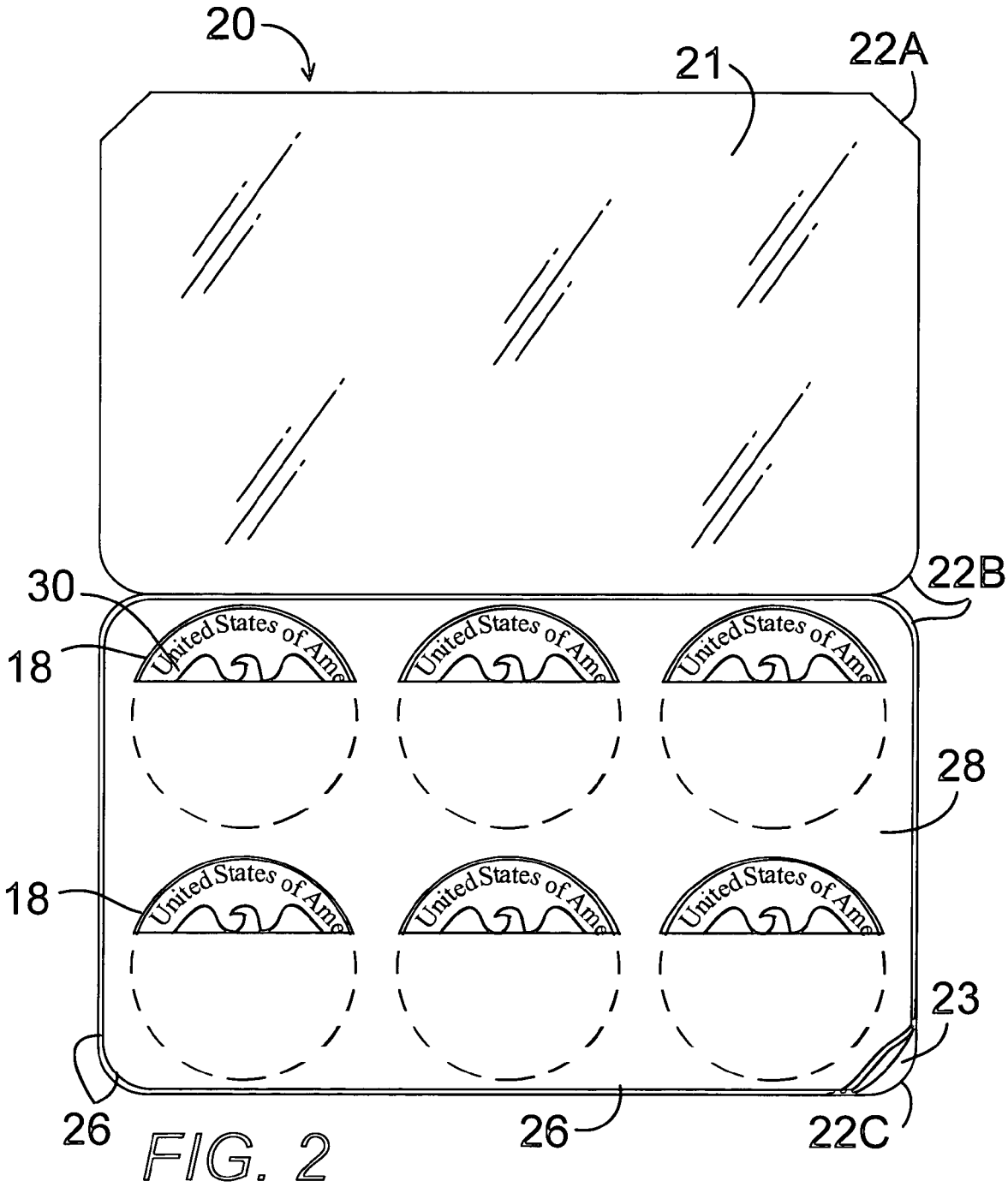
FIG. 2 is a rear elevational view of the coin holder folder of FIG. 1 showing a backing sheet with the finger holes for pushing the coins forward to assist in removing them.

A backing sheet 28 is attached to a backside of the coin holding card 23 around a perimeter of the coin holding card. The backing sheet (as seen in FIG. 2) has a series of openings 18 in alignment with a top of each row of circular openings 19. The series of openings are positioned above at least one coin-securing strip 25. Each of the series of openings 18 are smaller than a coin 30 to be placed in the device to prevent a coin from passing through the opening and sufficiently larger to admit a finger 50 of a user through a back side of one of the openings 18, as shown in FIG. 4B, to push the coin 30 forward away from the coin holding card 23 over the coin securing strip to enable the coin 30 to be grasped by a user from the front of coin holding card to remove the coin easily from the front of the device.

Figure 3:
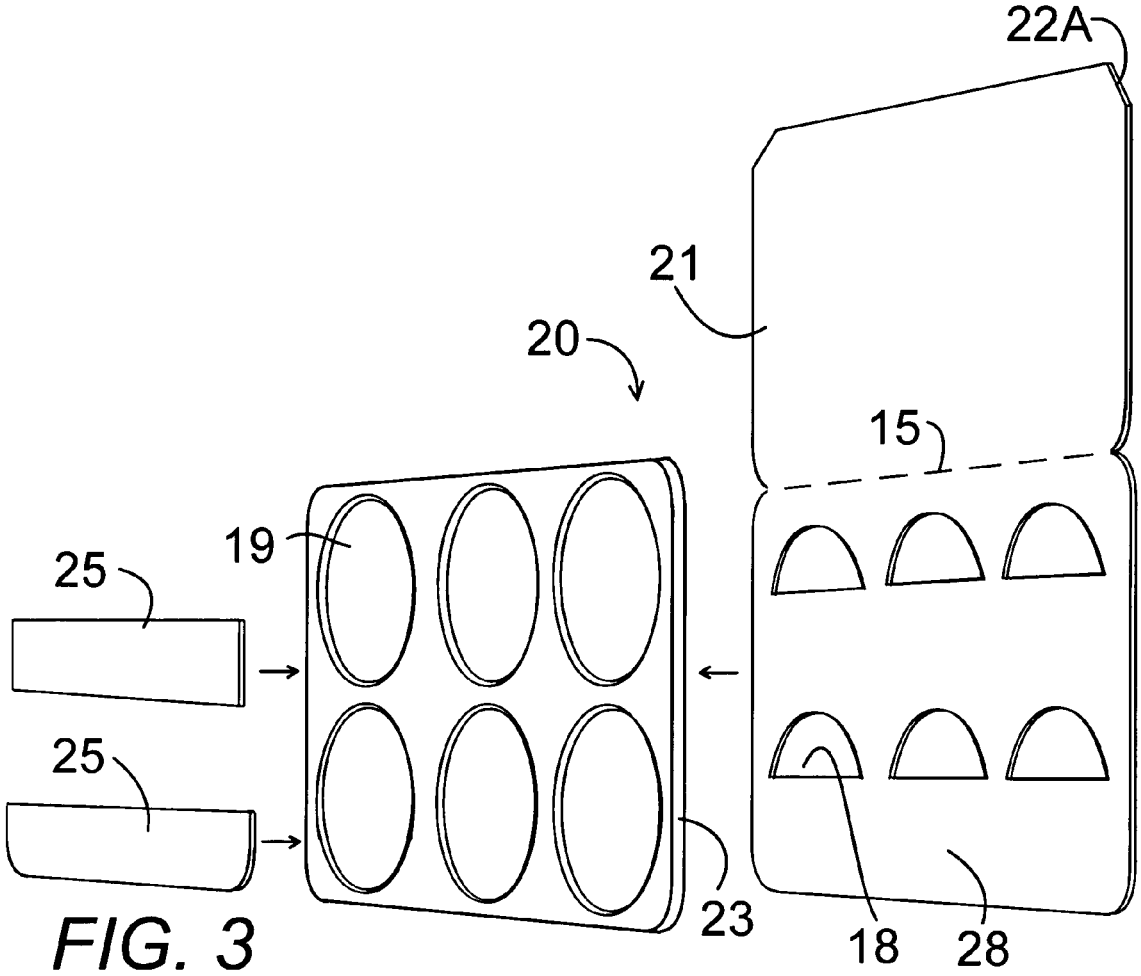
FIG. 3 is an exploded view of the components of the coin holder folder of FIG. 1 aligned for assembly.
Figure 4:
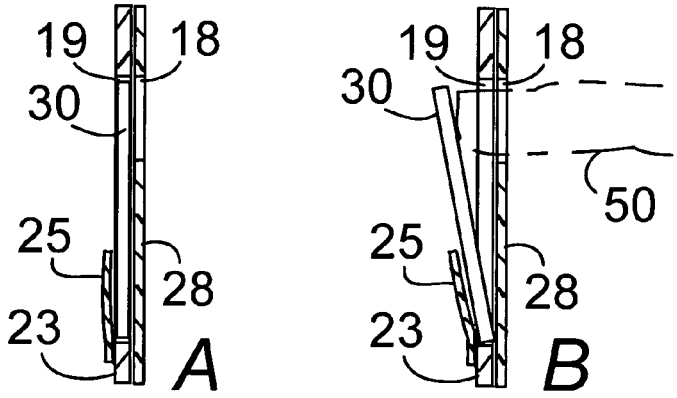
FIG. 4A is a cross-sectional view taken through the coin holder folder of FIG. 1 at one of the circular openings showing a coin in place in one of the circular openings.
FIG. 4B is a cross-sectional view taken through the coin holder folder of FIG. 1 at one of the circular openings showing a coin being pushed forward from one of the circular openings.

A cover sheet 21 which is preferably formed in one continuous sheet with the backing sheet 28, as shown in FIG. 3, is adapted to fold down along fold line 15 (dashed) from the top of the coin holding card down over a front of the coin holding card. The cover sheet has a length sufficient to extend from the top of the coin holding card to an interior of a space 24 between a coin securing strip 25 and the coin holding card 23 so that the cover sheet 21 is adapted to fit therein with a tight friction fit to maintain the cover sheet over coins housed in the device forming a closable folder to retain coins 30 therein.

The coin holding card 23 is substantially rectangular in shape with trimmed corners 22B and 22C. A bottom coin securing strip 25 that is attached along a bottom of the coin holding card has bottom ends which conform to the trimmed corners 22C of the coin holding card for ease of sliding the holder into a wallet and to prevent sharp corners from poking into a leg of a person if the device is placed in a pocket. Two corners 22A of the cover sheet 21 are trimmed to mate with the bottom trimmed corners 22C of the device to fit within the overlapping bottom coin securing strip 25.

The coin openings 19 are all the same size for a series of similar coins 30, preferably quarters, although they could be sized differently to fit a variety of denominations of coins in the same holder. The coin openings 19 are preferably formed in two rows of three openings 19 each so that the device 20 is adapted to hold six quarters and the coin holding card 23 is the thickness of a quarter (as seen in FIG. 4A).

In use, a plastic card-type coin holder folder 20 holds six quarters 30 in holes 19 located in the card. Two strips of plastic 25 across the front hold the quarters, and a strip of thin plastic backing 28 with back holes 18, preferably quarter-moon shaped, is attached to the back of the card. The back holes 18 enable a user to push the quarters forward, is in FIG. 4B, allowing them to be removed from the front of the card. A thin plastic cover sheet 21 folds down over the front of the coins and tucks between the bottom strip 25 and the card 23 to hold the cover closed.

It is understood that the preceding description is given merely by way of illustration and not in limitation of the invention and that various modifications may be made thereto without departing from the spirit of the invention as claimed.

What is claimed is:

1. A coin holder folder device for storing a number of coins in a flat array, the device comprising:

a coin holding card comprising a credit card size rigid sheet having at least one row of circular openings therethrough, each of the circular openings of a diameter slightly larger than a coin to be received therein; at least one coin securing strip attached to a front side of the coin holding card in alignment with a bottom portion of the at least one row of circular openings, the at least one coin securing strip comprising a flexible sheet having four sides with three of the four sides attached to the coin holding card having a bottom one of the three sides attached below the at least one row of circular openings, two sides of the at least one coin securing strip attached adjacent to two side edges of the coin holding card, and a fourth side at the top of the at least one coin securing strip aligned with a mid portion of the at least one row of circular openings so that the at least one coin securing strip is open at the top to admit a coin into each of the at least one row of circular openings and release a coin to be removed therefrom, the at least one coin securing strip having a height less than a diameter of each of the circular openings so that a portion of a coin in each of the circular openings is exposed above the coin securing strip, a backing sheet attached to a back side of the coin holding card around a perimeter of the coin holding card, the backing sheet having a series of backing sheet openings therethrough in alignment with a top of each of the at least one row of circular openings, the series of backing sheet openings positioned above the at least one coin securing strip, each of the series of backing sheet openings smaller than a coin to be placed in the device to prevent a coin passing through the backing sheet opening and sufficiently large to admit a finger of a user through a back side of one of each of the backing sheet openings to push a top of a coin in a circular opening forward tilting the coin away from the coin holding card over the top of the coin securing strip to enable the coin to be grasped by a user from a front of the coin holding card to remove the coin from the device, and a cover sheet attached to a top of the coin holding card, the cover sheet adapted to fold down from the top of the coin holding card down over a front of the coin holding card, the cover sheet having a length sufficient to extend from the top of the coin holding card to an interior of a space between the at least one coin securing strip and the coin holding card so that the cover sheet is adapted to fit therein with a tight friction fit to maintain the cover sheet over coins housed in the device forming a closable folder to retain coins therein.

2. The device of claim 1 wherein the coin holding card is substantially rectangular in shape with trimmed corners and a bottom one of the at least one coin securing strips is attached along a bottom of the coin holding card and the bottom ends of the bottom coin securing strip are trimmed to conform to the trimmed corners of the coin holding card for ease of sliding the holder into a wallet and to prevent sharp corners from poking into a leg of a person if the device is placed in a pocket, and two corners of the cover sheet are trimmed to mate with the bottom trimmed corners of the device to fit within the overlapping bottom one of the coin securing strips.

3. The device of claim 1 wherein the coin holding card has two spaced rows of coin openings therein and the at least one of the coin securing strips comprises two coin securing strips heat staked on three sides in two spaced positions on the coin holding card each of the coin securing strips covering a portion of the coin openings in one of the rows.

4. The device of claim 1 wherein the corners of the coin holding card are curved.

5. The device of claim 1 wherein the coin openings are all the same size for a series of similar coins.

6. The device of claim 5 wherein the coin openings are each slightly larger in diameter than a quarter so that the device is adapted for receiving quarters.

7. The device of claim 6 wherein the coin openings are formed in two rows of three openings each and the device holds six quarters.

8. The device of claim 7 wherein the coin holding card is the thickness of a quarter.

9. The device of claim 1 wherein the cover sheet is formed in one continuous sheet with the backing sheet.

* * * * *